US009711847B2

(12) United States Patent
Tran et al.

(10) Patent No.: US 9,711,847 B2
(45) Date of Patent: Jul. 18, 2017

(54) APPARATUS AND METHOD FOR INTEGRATING A REDUCED-SIZED ANTENNA WITH AN ACCESSORY CONNECTOR

(71) Applicant: MOTOROLA SOLUTIONS, INC, Schaumburg, IL (US)

(72) Inventors: Chi T. Tran, Weston, FL (US); Giorgi G. Bit-Babik, Plantation, FL (US); Antonio Faraone, Fort Lauderdale, FL (US); Jorge L. Garcia, Plantation, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 97 days.

(21) Appl. No.: 14/211,582

(22) Filed: Mar. 14, 2014

(65) Prior Publication Data

US 2015/0263419 A1 Sep. 17, 2015

(51) Int. Cl.
*H01Q 1/50* (2006.01)
*H01Q 1/08* (2006.01)
(Continued)

(52) U.S. Cl.
CPC ..... *H01Q 1/50* (2013.01); *H01Q 1/088* (2013.01); *H01R 24/44* (2013.01); *H01R 24/86* (2013.01);
(Continued)

(58) Field of Classification Search
CPC ..... H01Q 1/24
(Continued)

(56) References Cited

U.S. PATENT DOCUMENTS 2,700,137 A * 1/1955 Ragan ..... 439/10
3,408,610 A * 10/1968 Clarkson ..... 439/18
(Continued)

FOREIGN PATENT DOCUMENTS

EP 01766721 A2 3/2007
EP 2 911 239 A1 8/2015
(Continued)

OTHER PUBLICATIONS

Yaesu; Vertex Standard Co., Ltd.; VX-3R Operating Manual; Aug. 12, 2010.*
(Continued)

*Primary Examiner* — Dameon E Levi
*Assistant Examiner* — Ab Salam Alkassim, Jr.
(74) *Attorney, Agent, or Firm* — Barbara R. Doutre

(57) ABSTRACT

A system including a base affixed to a radio. The base includes a first base connector and a second base connector with a plurality of radial interconnectors positioned around the perimeter of the first base connector. The system includes an antenna connector including a first antenna connector and a second antenna connector with a plurality of radial interconnectors positioned around the perimeter of the first antenna connector. The first base connector is connected to the first antenna connector to form a central radio frequency (RF) coaxial connection and a first transmission line for a first antenna. The second antenna connector is connected to the second base connector to form a second transmission line and a plurality of radial connections around the perimeter of the central RF coaxial connection. The plurality of radial connections is configured to function as a signal carrier and/or an additional RF element.

27 Claims, 5 Drawing Sheets

100
RF ANTENNA CONNECTION SYSTEM

(51) Int. Cl.
*H01R 24/44* (2011.01)
*H01R 24/86* (2011.01)
*H01R 13/625* (2006.01)
*H01R 107/00* (2006.01)

(52) U.S. Cl.
CPC ..... *H01R 13/625* (2013.01); *H01R 2107/00* (2013.01); *Y10T 29/49018* (2015.01)

(58) Field of Classification Search
USPC ..... 343/702, 905, 906, 745; 439/63, 156, 439/394
See application file for complete search history.

(56) References Cited

U.S. PATENT DOCUMENTS 3,936,116 A 2/1976 Spinner
4,636,016 A 1/1987 Ford, Jr.
4,955,828 A * 9/1990 Gruenberg ..... H01R 24/38 439/668
5,118,309 A * 6/1992 Ford ..... H01R 24/58 439/620.21
2005/0272310 A1* 12/2005 Tsao ..... 439/578
2006/0073787 A1* 4/2006 Lair ..... H04M 1/6066 455/41.1
2007/0024522 A1* 2/2007 Lee ..... H01Q 1/084 343/906
2009/0128427 A1* 5/2009 Nawa ..... H01Q 1/22 343/702
2010/0238088 A1* 9/2010 Mukai ..... H01Q 9/30 343/859
2011/0215986 A1* 9/2011 Tongue ..... 343/895
2011/0221654 A1* 9/2011 Hsu ..... 343/906
2013/0288615 A1 10/2013 Anand
2014/0179239 A1* 6/2014 Nickel ..... H04W 24/00 455/67.14
2014/0322970 A1* 10/2014 Binder ..... 439/578

FOREIGN PATENT DOCUMENTS

JP 2000-196488 A 7/2000
JP 2000196488 A * 7/2000

OTHER PUBLICATIONS

Combined Search and Examination Report mailed Sep. 14, 2015, for corresponding GB Patent Application No. 1503577.7, filed Mar. 3, 2015.

* cited by examiner

100
RF ANTENNA CONNECTION SYSTEM

200
ANTENNA ATTACHMENT

300
OVERALL ANTENNA

APPARATUS AND METHOD FOR INTEGRATING A REDUCED-SIZED ANTENNA WITH AN ACCESSORY CONNECTOR

BACKGROUND OF THE INVENTION

Radios have historically included a side accessory connector for attaching an accessory to the radio. The inclusion of a side accessory connector in the frame/housing of a radio influences the cost, size, and form of the radio. For example, when a radio designed with relatively thin sides is to incorporate a side accessory connector, the sides of the radio must be designed to be sufficiently wide to accommodate the side accessory connector. Therefore, removal of the accessory connector from the side of the radio allows for the radio cost and size to be further reduced.

The side accessory connector may connect accessories that provide a radio frequency (RF) interface (transmitting, receiving, or transceiving RF signals). Therefore, an internal switch is required within the radio to switch from a main antenna (for example, a coaxially-fed antenna attached to the top of the radio) to the side-connected accessory, and vice versa. This internal switch also requires space within the radio unit that can further affect the cost and size of the radio.

When an antenna is affixed to the top of a radio, as previously described, the length of the antenna is typically relatively long. For example, the length of a VHF antenna, operating in the 136-174 MHz range, affixed to the top of a radio may reach 24 cm. The relatively long length of the antenna may hinder movements of a user wearing the radio on, for example, a belt-supported carry accessory. Consider an example where a user is equipped with a belt-worn radio. As the user moves into and out of a vehicle, the antenna may get caught in, for example, the seat belt. This relatively long length of the antenna may also result in the antenna hitting the user's body frequently during normal use. For instance, depending on the body size of the user, the tip of the antenna may stop right under the user's arm pit, causing discomfort. Accordingly, there is a need for a method and apparatus for reducing the size of an antenna and integrating an antenna with an accessory connector connected with an accessory via a cable.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
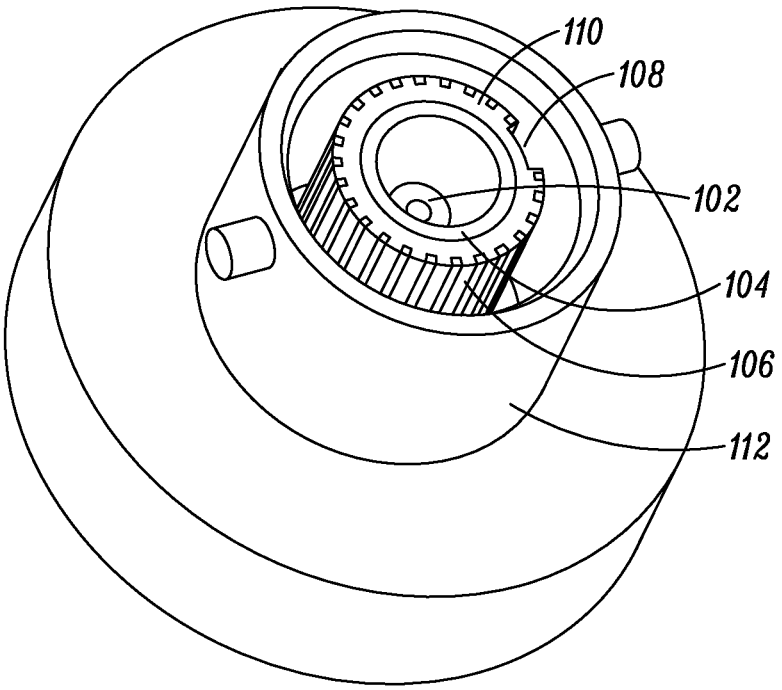
FIG. 1 is a diagram of a radio frequency (RF) antenna connection system incorporated in a radio in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some embodiments are directed to methods and apparatuses for forming an antenna connection system. The antenna connection system includes a base affixed to a radio. The base includes a first base connector and a second base connector with a plurality of radial interconnectors positioned around the perimeter of the first base connector. The antenna connection system also includes an antenna connector including a first antenna connector and a second antenna connector with a plurality of radial interconnectors positioned around the perimeter of the first antenna connector. The first base connector is connected to the first antenna connector to form a central radio frequency (RF) coaxial connection and a first transmission line for a first antenna in the radio. The second antenna connector is connected to the second base connector to form a second transmission line and a plurality of radial connections around the perimeter of the central RF coaxial connection, wherein the plurality of radial connections is configured to function as at least one of a signal carrier and an additional RF element.

FIG. 1 is a diagram of a radio frequency (RF) antenna connection system incorporated in a radio in accordance with some embodiments. RF antenna connection system 100 may include a radio housing 112 affixed to a coaxial connector 102 (also referred to as a RF connector 102 or a first base connector 102). RF connector 102 may be, for example, a micro miniature (also called "MMX") sized RF connector. RF connector 102 may feature a shield and a center conductor, the shield being connected to a metal chassis of the radio or (in the absence of a metal chassis) to a ground plane of the radio circuitry through a low impedance (for example, a short circuit) RF path. RF connector 102 may be used to connect a main antenna, for example, a Land Mobile Radio (LMR) antenna affixed to RF antenna connection system 100 for operation of the radio in one or multiple LMR-designated frequency bands. A RF ground element 104 (i.e., any good conductor including, for example, gold plated copper) may be wrapped around the perimeter of RF connector 102, making a low impedance (for example, a short circuit) RF connection with the shield of RF connector 102. An insulating material 110, for example, plastic, may be wrapped around RF ground element 104.

A radial connector 106 (also referred to as a second base connector 106) with individual radial interconnectors may be "wrapped"/positioned around the insulating material 110. In FIG. 1, only one of the radial interconnectors is annotated as radial connector 106 for ease of illustration. A non-limiting example of radial connector 106 includes a 30 pin base connector. The radial interconnectors—of radial connector 106 may provide one or more additional transmission lines to RF antenna connection system 100. The additional transmission lines may be used, for example, for audio signals (for example, for a microphone or speaker hosted in the side-mount accessory), as a universal serial bus (USB) interface, or for accessory identification. Hence, some of the additional transmission lines in radial connector 106 may be used to carry RF signals by effectively forming, for example, a ground-backed coplanar transmission line that is designed together with the other components of the connector to optimize for a specific characteristic impedance of the line (for example, 50 Ohm). Thus, some radial interconnectors positioned around the perimeter of the insulating material 110 may act as ground conductors to help form the additional transmission lines. These ground interconnectors are electrically connected with an RF ground element 104 through a low impedance RF path.

The additional RF transmission line(s) may be used to feed one or more additional antennas associated with one or more accessories within a collection of accessories that are compatible with the disclosed connector. The additional antennas may operate on different frequency bands (for example, GPS, WLAN, Bluetooth, and/or LTE) than the frequency bands on which the main antenna operates. Having a separate feed for the additional antenna(s) eliminates the need for diplexer circuits, may improve overall system efficiency, and provides more flexibility in designing the antenna radiating elements. System 100 therefore provides the ability to launch RF signals and make additional connections from one or more additional antennas integrated in the same antenna structure.

The additional lines provided by radial connector 106 also allows for operating at least one tunable antenna among those that can be hosted in the accessory, where the tunable antenna may be controlled by applying control voltages to tuning elements (not shown), for instance tunable capacitors, which are embedded in RF antenna connection system 100 or in the connected accessory. Other interconnector elements in RF connector 106 may supply the biasing voltages that may be required to turn on the tuning elements. Alternatively, when a main LMR antenna is affixed to the radio, rather than the accessory, the available tuning signal lines can be used to operate tuning elements embedded in the antenna.

The geometrical form of the main LMR antenna may be, for example, a relatively short extension from the housing of the radio when compared with the geometrical form of a main LMR antenna in a radio with a side accessory connector. Considering that for the same antenna efficiency/gain, a smaller antenna length reduces the antenna bandwidth, in some embodiments, the main LMR antenna may seem like an "internal antenna" with relatively narrow bandwidth. The main LMR antenna can also feature a tunable main LMR antenna that may be controlled by supplying control voltages to tuning elements using, for example, radio software. Therefore, a main LMR antenna with relatively narrow instantaneous bandwidth (bandwidth provided in each tuning state) that can be tunable may be configured to cover a full operating bandwidth. Accordingly, while an overall antenna structure formed in accordance with some embodiments may have a relatively smaller length than that of past coaxially-fed antenna structures, the overall antenna structure can be configured to cover a full operating bandwidth. Because the overall antenna structure may include the main tunable LMR antenna and at least one other tunable antenna, the main LMR antenna and the tunable antenna(s) may be configured to cover a full LMR operating bandwidth as well as other frequency bands (for example, GPS, WLAN, Bluetooth, and/or LTE).

In some embodiments, RF antenna connection system 100 may incorporate twenty four interconnectors or twelve interconnectors with redundancy. A notch 108 may be provided for aligning radial connector 106 with a corresponding radial connector on an antenna connector (as shown, for example, in FIG. 2) when the antenna connector is attached to RF antenna connection system 100 (as shown, for example, in FIG. 3).

Figure 2:
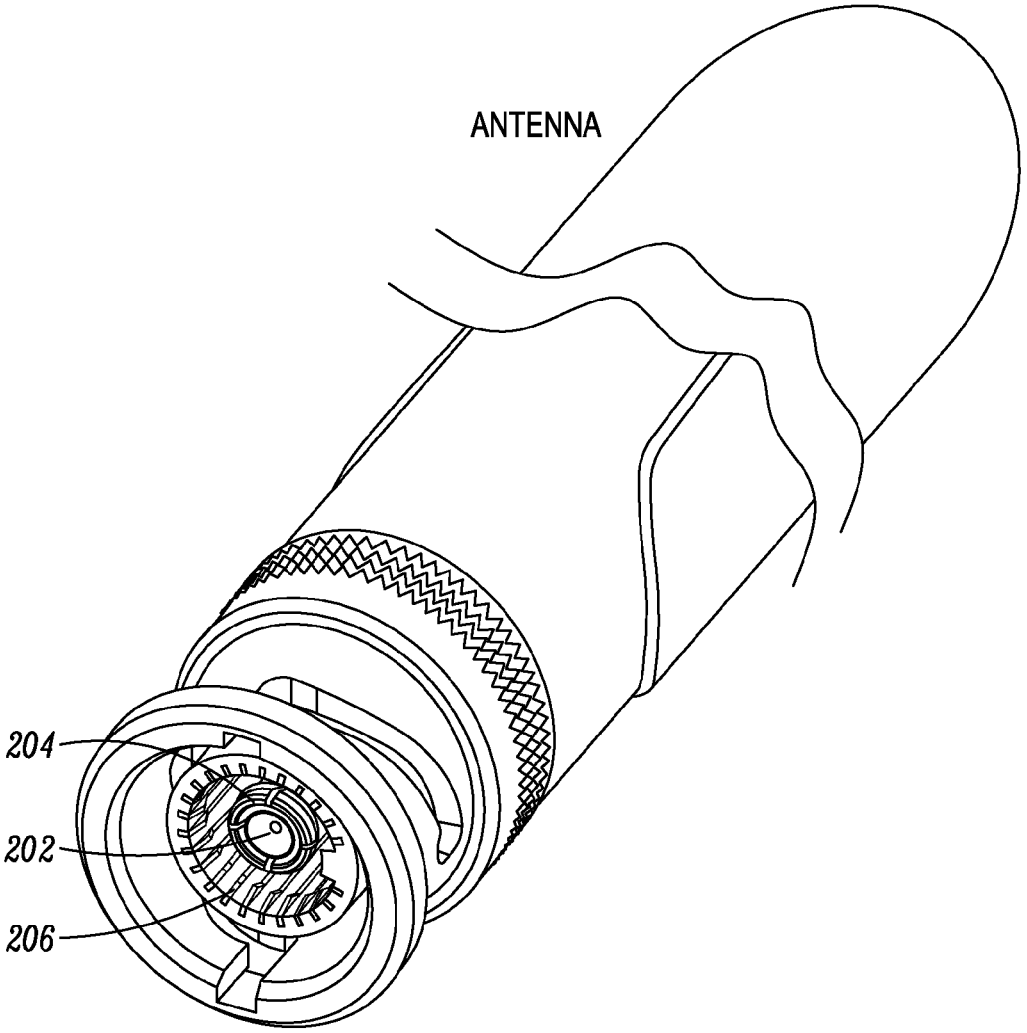
FIG. 2 is a diagram of an antenna connector formed in accordance with some embodiments.

FIG. 2 is a diagram of an antenna connector formed in accordance with some embodiments. Similar to RF antenna connection system 100, antenna connector 200 may include a coaxial connector 202 (also referred to herein as a first antenna connector), an RF ground element 204 wrapped around the perimeter of coaxial connector 202, and a radial connector 206 (also referred to herein as a second antenna connector) wrapped around RF ground element 204.

Figure 3:
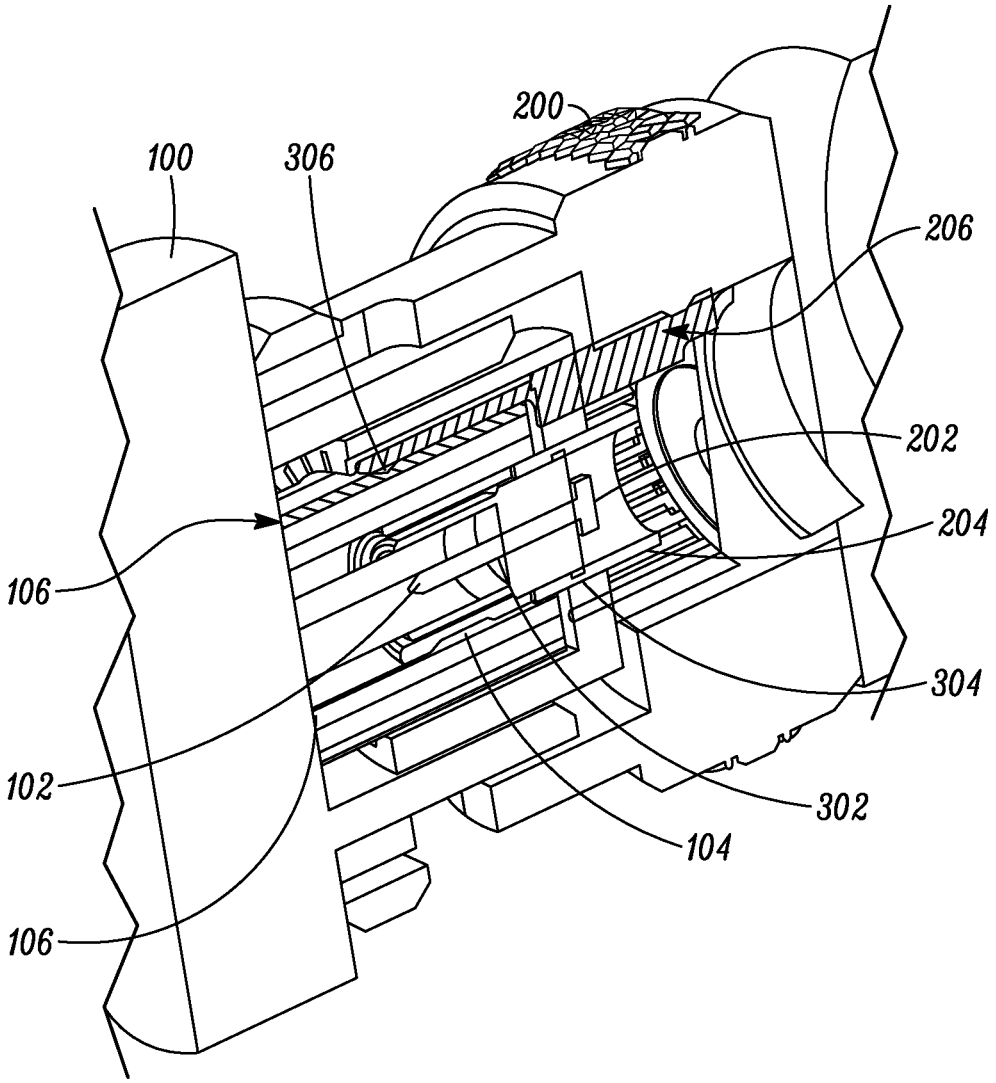
FIG. 3 is a cross sectional view of an antenna connector mated with an RF antenna connection system to form an overall antenna structure in accordance with some embodiments.

FIG. 3 is a cross sectional view of an antenna connector mated with an RF antenna connection system to form an overall antenna structure in accordance with some embodiments. In FIG. 3, coaxial connection 302 may be formed by connecting coaxial connector 202 with coaxial connector 102, RF ground 304 may be formed around coaxial connection 302 by connecting RF element 104 with RF element 204, and a radial connection 306 may be formed by connecting radial connector 206 with radial connector 106. While FIG. 3 shows a cross section of connection 306 (formed by the connection of radial connector 206 with radial connector 106), it is understood that a plurality of connections 306 may used depending on the application and desired redundancy, if any.

The overall antenna 300 formed by connecting connector 200 to the RF antenna connection system 100, as shown in FIG. 3, may be modulated based on the connections between the radio and the antenna connector. The radial interconnectors provided in radial connection 306 function to reduce the amount of cabling required for a wide band antenna because one of more of the additional antenna(s) enabled via the radial interconnectors may be tuned to sub-portion(s) of an overall band. Accordingly, by tuning one or more of the additional antennas to specific sub-portions of the overall band, when taken together, all of the antennas (i.e., the LMR antenna and the additional antennas) may cover the overall band.

The main LMR antenna may include passive or active components. The active components may be controlled by the tuning elements described above to effectively form a tunable LMR antenna. The additional antenna(s) may also include active components and passive components. For example, an active component associated with an additional antenna may be powered on and have a bias in voltage and may perform certain functions, wherein the active component may, for example, change a certain impedance state that in turn modifies the frequency response of the associated antenna and adapts to the need of the user. The active component in this example may use three radial interconnectors, for example three connections like connection 306, a voltage bias/ground pin, a pin for powering up the antenna, and a pin for changing its impedance state. A passive component may not be bias by voltage and may just have voltage applied to it. An example of a passive component is a capacitor that may change its capacitance to modify the frequency response of an associated antenna and adapt to the need of the user. The passive component in this example may use two radial interconnectors, such as two connections like connection 306, a voltage bias terminal and a ground terminal.

By adding additional transmission lines using radial connection 306, antenna 300 provides the benefit of enabling a tunable antenna control by supplying the control voltages to elements of radial connection 306. Some embodiments therefore provide additional electrical connections into the main antenna connector that is typically located on the top of the radio, while reducing the size of the overall antenna structure. Incorporating additional transmission lines into the overall antenna structure also provides additional flexibility in designing the form of the radio (for example, by eliminating the need for side accessory connectors), as will be shown and described in conjunction with FIG. 5. Incorporating additional transmission lines into the overall antenna structure also allows for a reduced radio size (by, for example, eliminating the need to package internal GPS/LTE/Bluetooth/Wifi antennas and circuitry into the radio), and improves overall antenna efficiency by enabling tuning of the additional antennas. By eliminating the need to package internal GPS/LTE/Bluetooth/Wifi antennas and circuitry into the radio, these additional antennas may be placed in the radio main body where they cannot be easily interfered with by the user's hands.

Figure 4:
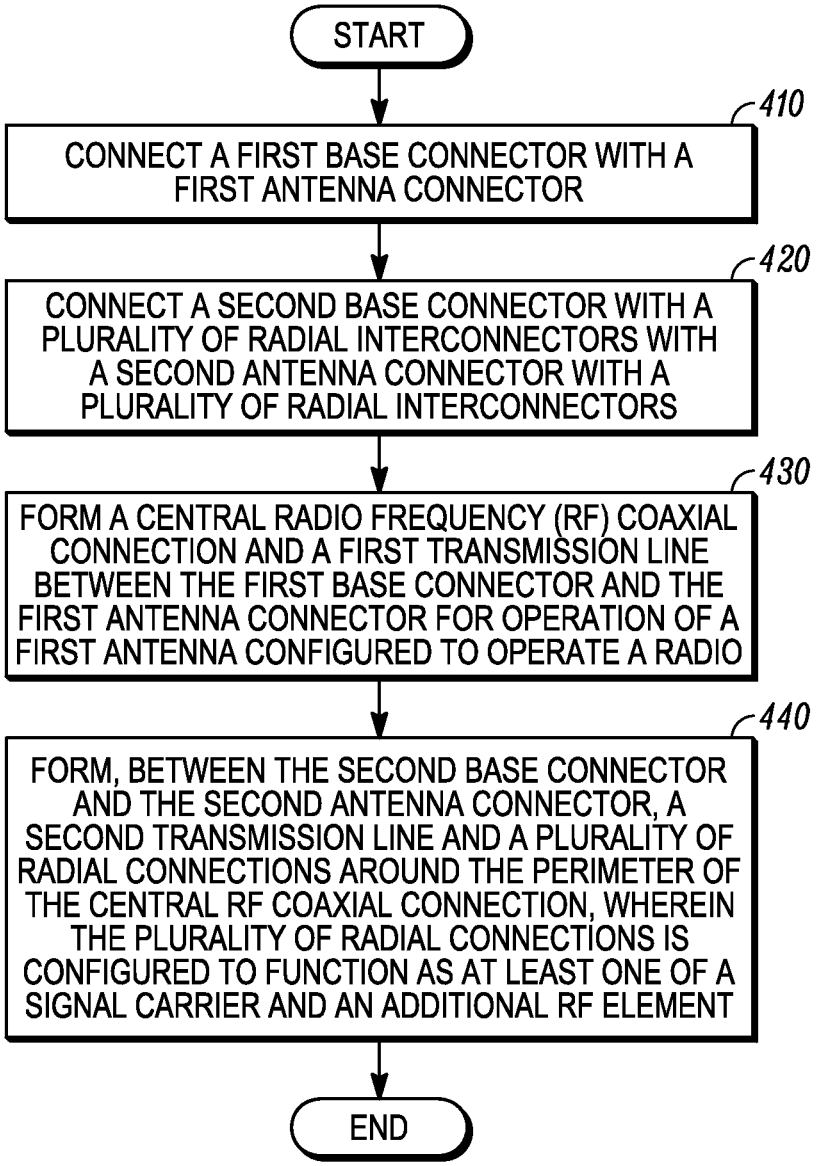
FIG. 4 is a flow diagram of connection steps implemented in accordance with some embodiments.

FIG. 4 is a flow diagram of connection steps implemented in accordance with some embodiments. At 410, connect a first base connector with a first antenna connector. At 420, connect a second base connector with a plurality of radial interconnectors with a second antenna connector with a plurality of radial interconnectors. The radial interconnections of the second base connector are positioned around the first base connector and the radial interconnections of the second antenna connector are positioned around the first antenna connector. At 430, form a central RF coaxial connection and a first transmission line between the first base connector and the first antenna connector for operation of a first antenna configured to operate a radio. At 440, form, between the second base connector and the second antenna connector, a second transmission line and a plurality of radial connections around the perimeter of the central RF coaxial connection, wherein the plurality of radial connections is configured to function as at least one of a signal carrier and an additional RF element.

Figure 5:
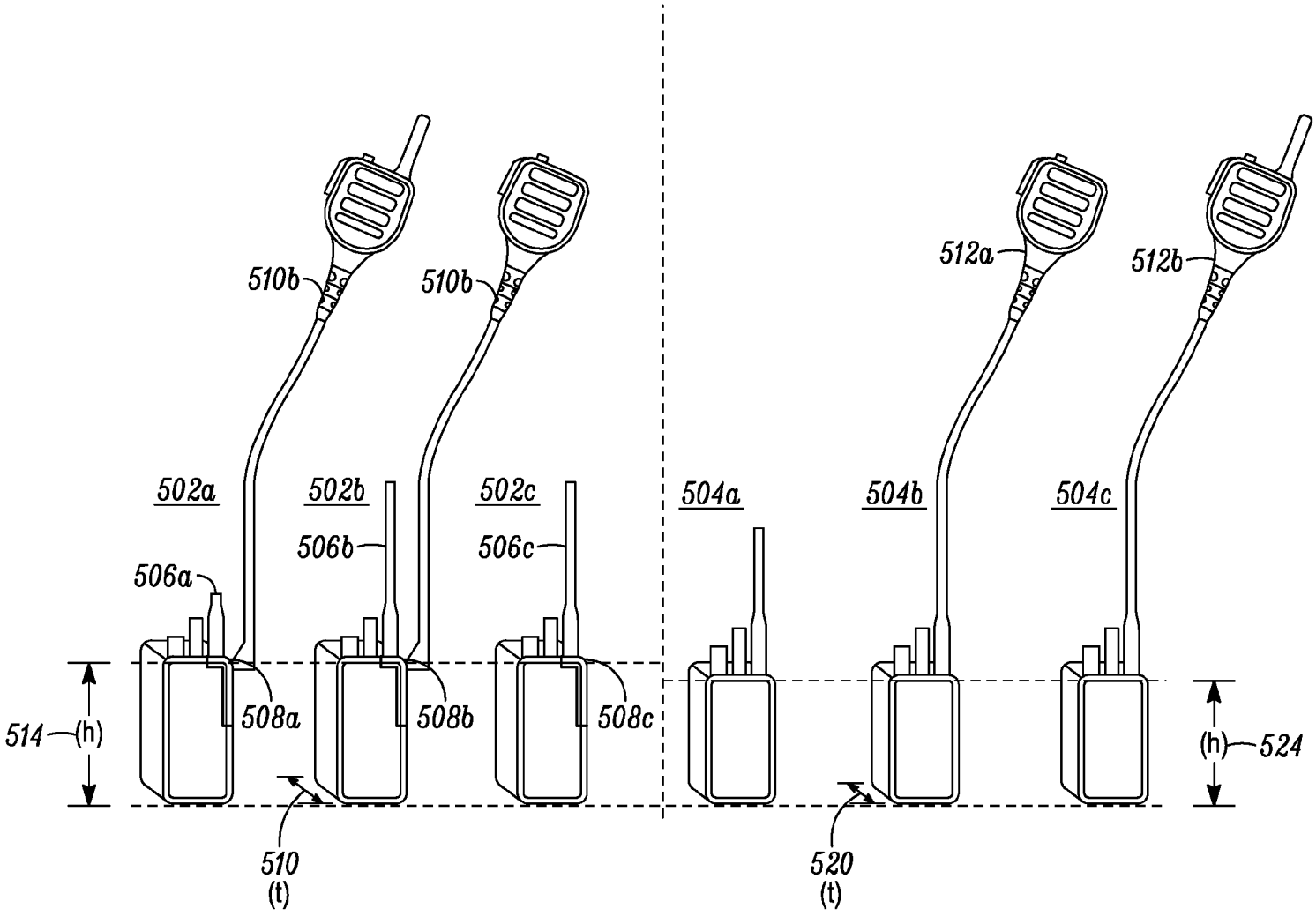
FIG. 5 is a diagram for contrasting radios incorporating other antenna structures with radios incorporating the overall antenna structure in accordance with some embodiments.

FIG. 5 is a diagram for contrasting radios incorporating other antenna structures with radios incorporating the overall antenna structure in accordance with some embodiments. Radios 502 (i.e., radios 502*a*, 502*b* and 502*c*) incorporate an antenna structure wherein a main antenna (i.e., antenna 506*a*, 506*b* and 506*c*) for operating radio 502 is housed on top of radio 502 and each of radios 502 includes an accessory connector (i.e., accessory connector 508*a*, 508*b* and 508*c*) for attaching an accessory, for example, accessory 510*a* and 510*b*, to radio 502. The inclusion of side accessory connector 508 in the frame/housing of radio 502 influences the size and form of radios 502 and thereby causes radios 502 to have larger internal volume and overall radio size. Radios 504 (i.e., radios 504*a*, 504*b* and 504*c*), on the other hand, incorporate the overall antenna structure of some embodiments. Accordingly, an accessory 512 (for example, accessory 512*a* and 512*b*) may be attached to radios 504 without using an accessory connector, thereby causing radios 504 to have smaller internal volume and overall radio size. The radios 504, comprising the antenna structure formed in accordance with some embodiments, have a shorter height 524 and thickness 520, than radios 502 having height 514 and thickness 510.

Some embodiments therefore provide the benefit of enabling a tunable antenna control by supplying the control voltages to elements of a radial connection in the antenna structure. In some embodiments, enabling tuning of the main LMR antenna and/or the additional antennas incorporated in the antenna structure improves the overall antenna efficiency. Some embodiments provide additional electrical connections into a main antenna connector, while reducing the size of the overall antenna structure. Some embodiments also incorporate additional transmission lines into the overall antenna structure, thereby providing additional flexibility in designing the form of the radio, for example, by eliminating the need for side accessory connectors.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An antenna connection system for a portable radio, comprising:

a base affixed to a top surface of the portable radio, the base including a first base connector and a second base connector, the second base connector including a plurality of radial interconnectors positioned around the perimeter of the first base connector, each radial interconnector of the plurality of radial interconnectors comprises a transmission line running lengthwise along the second base connector, and an antenna attachment including a first antenna connector and a second antenna connector, the second antenna connector including a plurality of radial interconnectors positioned around the perimeter of the first antenna connector, each radial interconnector of the plurality of radial interconnectors comprises a transmission line running lengthwise along the second antenna connector, wherein the first base connector is connected to the first antenna connector to form a central radio frequency (RF) coaxial connection, the central radio frequency (RF) coaxial connection providing a first transmission line for a first antenna in the portable radio, and wherein the second antenna connector is connected to the second base connector to couple each transmission line of the of the second base connector to each transmission line of the second antenna connector thereby forming a plurality of radial connections around the perimeter of the central RF coaxial connection, wherein the plurality of radial connections function as at least one of a signal carrier and an additional RF element.

2. The antenna connection system of claim 1, wherein at least one of the plurality of radial connections carry an RF signal that is used to feed a second antenna integrated in a housing of the antenna connection system.

3. The antenna connection system of claim 2, wherein the second antenna operates on a different frequency band than the first antenna formed by connecting the first antenna connector to the first base connector.

4. The antenna connection system of claim 2, wherein at least one of the first antenna and the second antenna is a tunable antenna.

5. The antenna connection system of claim 1, wherein the first base connector is a coaxial connector and the second base connector is a radial connector.

6. The antenna connection system of claim 1, wherein the plurality of radial connections includes at least one of an active component and a passive component for supplying control voltages to tuning elements embedded in the antenna connection system.

7. The antenna connection system of claim 1, further comprising a notch for aligning the second antenna connector with the second base connector.

8. The antenna connection system of claim 1, wherein a ground element is wrapped around the first base connector, an insulating material is wrapped around the ground element and the second base connector is wrapped around the insulating material.

9. The antenna connection system of claim 1, wherein a ground element is wrapped around the first antenna connector and the second antenna connector is wrapped around the ground element.

10. The antenna connection system of claim 1, wherein the first transmission line is for antenna operation of the portable radio and the second transmission line is for operation of an accessory, and wherein the antenna connection system is located on a top surface of the portable radio.

11. A method, comprising:

connecting a first base connector located on a top surface of a portable radio with a first antenna connector;

connecting a second base connector including a plurality of radial interconnectors positioned around the perimeter of the first base connector with a second antenna connector including a plurality of radial interconnectors positioned around the perimeter of the first antenna connector, wherein the plurality of radial interconnectors of the second base connector form transmission lines running lengthwise along the second base connector for coupling with the plurality of radial interconnectors of the second antenna connector formed of transmission lines running lengthwise along the second antenna connector;

forming a central radio frequency (RF) coaxial connection, the central radio frequency (RF) coaxial connection providing a first transmission line between the first base connector and the first antenna connector for operation of a first antenna;

and forming, between the transmission lines of the second base connector and the transmission lines of the second antenna connector:

a plurality of radial connections around the perimeter of the central RF coaxial connection, wherein the plurality of radial connections function as at least one of a signal carrier and an additional RF element.

12. The method of claim 11, further comprising:

using the first transmission line to feed the first antenna integrated in a housing of an antenna connection system; and using the second transmission line to feed a second antenna integrated in the housing of the antenna connection system.

13. The method of claim 11, further comprising operating the first transmission line on a first frequency and operating the second transmission line on a second frequency.

14. The method of claim 11, further comprising supplying voltages to a tuning element embedded in an antenna connection system via the second transmission line to enable a tunable antenna control.

15. The method of claim 11, further comprising aligning the second antenna connector with the second base connector.

16. The method of claim 11, further comprising wrapping a ground element around the first base connector, wrapping an insulating material around the ground element, and wrapping the second base connector around the insulating material.

17. The method of claim 11, further comprising wrapping a ground element around the first antenna connector and wrapping the second antenna connector around the ground element.

18. A communication system, comprising:

a portable radio;

an antenna connector coupled to a top surface of the portable radio, wherein the antenna connector comprises a plurality of radial connections positioned around a first coaxial connector portion; and an accessory coupled to the antenna connector;

wherein the antenna connector provides a first radio frequency (RF) transmission path through the first coaxial connector portion, and a second RF transmission path through the plurality of radial connections, the plurality of radial connections comprising transmission lines running lengthwise along the antenna connector, the first RF transmission path for operation of the portable radio and the transmission lines for operation of the accessory.

19. The communication system of claim 18, wherein the connector is coupled to a single surface of the radio.

20. The antenna connection system of claim 1, further comprising tuning elements for tuning an antenna of an accessory of the portable radio, wherein the accessory for the portable radio is coupled to the antenna connection system without using a side accessory connector.

21. The communication system of claim 18, wherein the accessory comprises an RF antenna for a remote speaker microphone and some of the plurality of radial connections of the second RF transmission path are used to carry RF signals to and from the RF antenna, and other of the plurality of radial connections of the second RF transmission path are used for signals of the speaker microphone.

22. The antenna connection system of claim 1, wherein the transmission lines of the of the second base connector are located in a main body of the portable radio thereby avoiding handheld interference.

23. The method of claim 11, wherein the transmission lines of the of the second base connector are located in a main body of the portable radio thereby avoiding handheld interference.

24. The communication system of claim 18, wherein the transmission lines of the plurality of radial connections for operation of the accessory are placed in a main body of the portable radio thereby avoiding handheld interference.

25. The antenna connection system of claim 1, wherein the signal carrier comprises at least one of: GPS, LTE, Bluetooth, and Wifi.

26. The method of claim 11, wherein the signal carrier comprises at least one of: GPS, LTE, Bluetooth, and Wifi.

27. The communication system of claim 18, wherein transmission lines operate at least one of: GPS, LTE, Bluetooth, and Wifi.

* * * * *